United States Patent [19]

Hazelett et al.

[11] Patent Number: 4,648,438

[45] Date of Patent: Mar. 10, 1987

[54] METHOD AND APPARATUS FOR FEEDING AND CONTINUOUSLY CASTING MOLTEN METAL WITH INERT GAS APPLIED TO THE MOVING MOLD SURFACES AND TO THE ENTERING METAL

[75] Inventors: Robert W. Hazelett; Charles J. Petry, both of Colchester; Stanley W. Platek, Essex Junction, all of Vt.

[73] Assignee: Hazelett Strip-Casting Corporation, Colchester, Vt.

[21] Appl. No.: 766,076

[22] Filed: Aug. 15, 1985

Related U.S. Application Data

[63] Continuation of Ser. No. 631,582, Jul. 17, 1984, abandoned, which is a continuation of Ser. No. 372,459, Apr. 28, 1982, abandoned.

[51] Int. Cl.[4] ..... B22D 11/06; B22D 11/00

[52] U.S. Cl. ..... 164/475; 164/481

[58] Field of Search ..... 164/66.1, 415, 430–434, 164/480–482, 475

[56] References Cited

U.S. PATENT DOCUMENTS

| | | | |
|---|---|---|---|
| 3,041,686 | 7/1962 | Hazelett et al. . | |
| 3,167,830 | 2/1965 | Hazelett et al. . | |
| 3,864,973 | 2/1975 | Petry . | |
| 3,871,905 | 3/1975 | Petry . | |
| 3,921,697 | 11/1975 | Petry . | |
| 3,937,270 | 2/1976 | Hazelett et al. . | |
| 4,002,197 | 1/1977 | Hazelett et al. . | |
| 4,053,010 | 10/1977 | Boccon-Gibod | 164/415 X |
| 4,062,397 | 12/1977 | Cashdollar, Sr. | 164/415 |
| 4,150,711 | 4/1979 | Hazelett et al. . | |

FOREIGN PATENT DOCUMENTS

| | | |
|---|---|---|
| 2655912 | 6/1978 | Fed. Rep. of Germany . |
| 2840699 | 4/1979 | Fed. Rep. of Germany . |
| 2504036 | 10/1982 | France . |

OTHER PUBLICATIONS

"Use of the Hazelett Twin-Belt Mold for Continuous Casting of Copper", by C. J. Petry.

"Expanding the Capabilities of the Hazelett Twin-Belt Caster: Mold Stabilization Techniques", by C. J. Petry, et al.

"The Present Status of Continuous Casting Between Moving Flexible Belts", by R. W. Hazelett.

"Hazelett Twin-Belt Caster", by C. J. Petry.

*Primary Examiner*—Kuang Y. Lin

*Attorney, Agent, or Firm*—Parmelee, Bollinger & Bramblett

[57] ABSTRACT

Methods and apparatus for feeding and continuously casting molten metal are described in which inert gas is applied to the moving mold surfaces and to the entering metal for the protection or shrouding of the molten metal surface within the mold cavity from oxygen and other detrimental atmospheric gases. The shrouding is by means of inert gas injected into the mold through a semi-sealing nosepiece, or directed at the mold cavity and passing through the necessary slight gaps around the nosepiece. At the same time, such inert gas is further circulated by channeling or shielding the circulated gas for blanketing and diffusing of the inert gas along the moving mold surfaces for cleansing them of undesired accompanying gases, such as atmospheric oxygen, water vapor, sulphur dioxide, carbonic acid gas, etc. as the mold surfaces approach the nosepiece before entering the mold region. In installations where the inert gas is directed at the mold cavity from above and/or below the nosepiece, the gas is ejected at a relatively slow flow rate so as to be noiselessly ejected, i.e. without audible disturbance, the objective being to avoid entrainment of air. Heavier-than-air inert gas may advantageously be used above the nosepiece, while lighter-than-air inert gas is simultaneously used below it.

24 Claims, 9 Drawing Figures

11
16
18
9
U
51
12
25
5
51
3
1
7
26
52
13
10
L
1
2
4
11

A
P
14
15
11
9
16
6
C
10
7
U
50
E
12
13
17
51
52
35
4

METHOD AND APPARATUS FOR FEEDING AND CONTINUOUSLY CASTING MOLTEN METAL WITH INERT GAS APPLIED TO THE MOVING MOLD SURFACES AND TO THE ENTERING METAL

This is a continuation of co-pending application Ser. No. 631,582 filed on July 17, 1984 which is a continuation application of Ser. No. 372,459 filed Apr. 28, 1982, both now abandoned.

BACKGROUND OF THE INVENTION

This invention relates to methods and apparatus for feeding and continuously casting molten metal for continuously casting metal strip, sheet, slab, plates, bars, or billets directly from molten metal introduced through a semi-sealing nosepiece into the casting region of a moving mold between spaced portions of two moving cooling surfaces which cool the metal being cast.

The invention herein is described as embodied in the structure and operation of casting machines in which the molten metal is fed through a semi-sealing nosepiece into the moving mold or casting region located between opposed portions of two moving water or liquid-cooled molds having surfaces defining the mold region. The moving molds in the illustrative examples shown are flexible bands or belts which act as cooling surfaces and enclose or confine the molten metal introduced into the moving mold between them, and they simultaneously move the molten metal progressively toward solidification into forms or products, such as strip, sheet, slab, plates, bars, or billets, hereinafter called the "cast product" or "product being cast". Continuous casting machines employing such flexible bands or belts, often called twin-belt casters, have been pioneered and manufactured for many years by the Hazelett Strip-Casting Corporation of Mallets Bay, Vt. If further information on various aspects of such machines is desired, it can be obtained from the patents assigned to that Company, the assignee of the present invention.

In the introduction, feeding, or charging of molten metal into the moving mold of a substantially horizontal or downwardly inclined continuous casting machine, critical factors for casting metal of acceptable quality and having appropriate surface qualities and surface characteristics for commercial applications are the avoidance of rapid changes in the velocity of the molten metal being introduced, and the avoidance of turbulence in the molten metal, the limiting of exposure of the metal to a reactive atmosphere or other reactive agents, and the provision of favorable interaction between the moving mold surfaces and the metal being confined by these surfaces.

Molten metal handling and distribution equipment, which conveys the molten metal to be cast from the melting or holding furnace to the mold region of the casting machine, is generally designed to avoid restrictions and to limit exposure of the molten metal to an uncontrolled atmosphere, usually accomplished by under-pouring at each transfer. Thus, the molten metal is not poured over an open lip, but instead is drawn well below the surface in the vessel, so as to leave behind surface oxides and most foreign matter. Such under-pouring technique further transfers or introduces the molten metal into the next vessel under the surface of the metal therein, in such a way as to minimize agitation and to avoid contact with atmospheric or oxygen-bearing agents. These strictures and techniques apply generally to the handling of molten lead, zinc, aluminum, copper, iron and steel, and to the alloys of these metals, as well as to other metals. Failure to observe such strictures and techniques may result in the uncontrolled formation of oxides, which tend to adversely affect the metallurgical qualities of the metal being cast, and which otherwise cause difficulty in the molten-metal feeding equipment and in the mold. In certain of these metals, relatively small percentages of oxygen are capable of causing such difficulties. Hydrogen may also become dissolved within the cast metal emanating from the dissociation of atmospheric water vapor molecules resulting from contact with the hot molten metal or from contact with hydrogen-bearing combustion gases. Such hydroggen dissolved, even in small quantities, can cause undesirable porosity. Even nitrogen may be unwelcome, under some conditions.

Oxidation problems within launders, troughs, and tubdishes have been generally solved by under-pouring, together with the use of reducing atmospheres applied to the surface of the molten metal. Such reducing atmospheres are obtained through flames of burning oil or gas which are rendered deficient in the oxygen supplied to them. In the case of aluminum, a protective oxide film will remain quietly upon the surface of an open vessel, when designed so as to minimze agitation, and in this case reducing atmospheres are not required in the preliminary stages of aluminum transfer with under-pouring.

Entrapment of oxides, or other impurities, is less apt to occur in the conventional vertical continuous casting processes, which use a rigid mold that is open at the top and bottom. In those vertical casting processes the pouring into the mold is generally accomplished by under-pouring, and at a relatively slow rate. Such oxides, and other impurities as do form, have time to float to the top, and thus they are prone to remain in the top oxide layer which forms there or to become frozen in the center or core region of the ingot of relatively large cross-sectional area being cast. In this case of vertical casting of large cross-sectional products, the entrapped oxides or other impurities are not likely to be detrimental to, nor render unacceptable, the products being cast.

The situation is quite different and peculiar in the casting of relatively thin, i.e. ¼ inch (6 mm) to 1½ inches (38 mm) sections in substantially horizontal or downwardly inclined continuous casting machines. When the mold region is elongated as in twin-belt casters, for example, the continuously moving mold surfaces are normally operated at relatively high linear speeds. Here the problems of entrapment of oxides, or other impurities, can be more serious and can render the product being cast unacceptable.

When casting such relatively thin sections, i.e. ¼ inch to 1½ inches, close to the horizontal, the technique of under-pouring for the introduction of the molten metal into the moving mold region of continuous casting machine is usually not practical or feasible, as there is insufficient vertical clearance between the mold surfaces. When casting such relatively thin sections, the molten metal is usually introduced through a semi-sealing nosepiece. As a practical matter this nosepiece must be spaced slightly away from the moving mold surfaces near the entrance to the mold region in order to compensate for the inevitable variables and variations in the entrance to the continuously moving mold. Such spacing from the continuously moving mold surfaces is also needed to allow for the dimensional tolerances involved in the forming and shaping of the refractory material having suitable physical, chemical and thermal properties for the demanding service of handling molten metal. The refractories suitable for this demanding purpose are difficult to shape and maintain within close and consistent operating tolerances.

Thus, the fit between the nosepiece for feeding molten metal and the continuously moving mold surfaces must be relatively loose, with an initial gap of 0.010 inch (0.25 mm) being customary for a new nosepiece. However, this gap, through wear, will tend to widen, especially on the top of the nosepiece. The periodic leakage of most molten metals around the sealing surfaces of the nosepiece is inevitable if the operator of the moving mold attempts to keep the mold region continuously filled up against the nosepiece with molten metal. In other words, it is just usually not practicable to attempt to keep the molten metal in the mold region full up against the nosepiece. Indeed, a gap of about 0.020 inch (0.5 mm) around the nosepiece will generally leak any molten metal of low surface tension, and such metal will readily, quickly solidify or freeze untimely into "fins", causing an undesirable jamming action against the nosepiece, resulting in destruction of the nosepiece.

Consequently, it is usually necessary to avoid filling the mold region so as to avoid back-up of the molten metal up to the nosepiece. Such attempted filling is somewhat more tolerable with aluminum, because of its high surface tension which tends to impede leakage through the gaps. Even with aluminum, however, a "head" of molten metal significantly higher than the upper mold region is to be avoided, because the resultant pressure in the molten aluminum at the gaps near the nosepiece will overcome the surface tension and cause leakage. Therefore, even with aluminum, the operator will often keep the level of molten metal in the mold region no higher than the front lower edge of the nosepiece, so that a considerable gas cavity will be present.

Actually, during the continuous casting, notably of aluminum, with a closely fitting nosepiece, a small gas cavity will persist despite a small head of metal pressure that is slightly higher than any point in the mold region; that is, higher than the location of said residual gas cavity. It is our belief that this phenomenon of an unintended residual gas cavity results in part from the dynamics of the in-feed and from the drag of the moving mold surfaces upon the surface of the molten metal, augmented by surface tension.

Therefore, as a result of intentional operation to avoid any chance for leakage of the molten metal to occur out through the gaps adjacent to the nosepiece or even where not intended, as a result of such dynamic drag phenomenon, there is usually a gas space or cavity within the mold region. This cavity is located in the upper portion of the mold region above the level of the molten metal and adjacent to the front end of the nosepiece.

It will be appreciated that with the nosepiece surfaces positioned within approximately 0.020 of an inch (0.5 mm) near the continuously moving mold surfaces, the operator is not able to ascertain by visual observation the physical status or level of the molten metal at any time in the mold region. Thus, the operator cannot rely upon visual observation to control the level of molten metal or to control the size of the above-described cavity. Novel methods and apparatus for overcoming the difficulties relating to the operator's lack of visible observation for pour level control are described and claimed in U.S. Pat. Nos. 3,864,973 and 3,921,697, whose disclosures are here incorporated by reference. The methods and apparatus of these patents have been successfully applied to twin-belt casters, where they eliminate the need to see physically the level of the molten metal. They have proven practical for control of twin-belt casters in commercial production. Thus, the use of a suitably fitting nosepiece becomes a practical way to introduce metal into the casting region, while maintaining a controlled cavity in the upper portion of the mold region between the nosepiece and the molten metal.

Molten aluminum and aluminum alloys in particular are highly reactive. They can combine with other metals, gases and refractories. For example, in a molten state during continuous casting, aluminum alloys are susceptible to random reaction with or are affected by atmospheric oxygen, water vapor, and trace atmospheric gas pollutants. In the continuous casting of aluminum alloys containing magnesium, random atmospheric contact results in reactions which, in turn, cause oxide spots or streaks on the cast surface, and will also reduce the fluidity of such alloys in a molten state.

The difficulties of uncontrolled oxidation and reaction of the molten metal are compounded in two ways, when relatively thin sections of the order of ¼ inch (6 mm) to 1½ inches (38 mm) are being continuously cast. First, there is the cited problem of lack of clearance for means to underpour the metal into the continuously moving mold region, but secondly, the ratio of surface area to volume is increased with such thin sections. As oxidation is generally a surface or interface reaction, oxide formation on such relatively thin continuously cast sections constitutes a greater relative proportion of the product as contrasted with thick sections. Also, with such thick sections it is practical to scalp oxides from the surface of the cast product, but not with the relatively thin sections.

While a portion of the above description has been in terms of twin-belt casting machines, the same problems occur with other types of continuous casting machines in casting relatively thin sections in a horizontal or downwardly inclined mode.

SUMMARY OF THE INVENTION

Among the objects of this invention are to provide methods and apparatus for the in-feeding and settling of molten metal and the continuous casting of metal products of acceptable surface qualities and characteristics, and acceptable internal structure and qualities in relatively thin sections, i.e. ¼ inch (6 mm) to 1.5 inches (38 mm) via continuous casting machines employing a moving, horizontal or downwardly inclined mold region. The molten metal is introduced into the upstream or entrance end of the continuously moving mold region through a semi-sealing nosepiece accurately mating or fitting with the moving mold surfaces and having clearance gaps from the moving mold surfaces of less than 0.050 of an inch (1.27 mm) while inert gas is applied to the moving mold surfaces and to the entering metal for the protection or shrouding of the molten metal surface within the mold cavity from oxygen and other detrimental atmospheric gases. An advantageous shrouding of in-feeding molten metal, controlled cavity in the upper end of the mold region and of the moving mold surfaces is accomplished by means of inert gas injected into the mold through the semi-sealing nosepiece, or directed at the mold cavity and passing through the clearance gaps around the nosepiece. Such inert gas is further circulated for cleansing the moving mold surfaces of undesired accompanying or adhering gases associated with the mold surfaces as the mold surfaces approach the nosepiece before entering the mold region.

The invention in certain of its aspects, as embodied in the illustrative methods and apparatus, comprises in-feeding molten metal through at least one passage in a nosepiece of refractory material inserted toward the upstream end of a continuously moving mold region and having clearance gaps of less than 0.050 of an inch (1.27 mm) from the continuously moving mold surface, securing the nosepiece with rigid support structure clamps above and below, supplying inert gas through at least one passage in at least one of the said clamps, to quietly introduce said inert gas into at least one of the narrow clearance gaps around the inserted nosepiece, for shrouding the entering molten metal and the controlled cavity in the upper end of the moving mold region.

The invention in other of its aspects as embodied in the illustrative methods and apparatus comprises in-feeding molten metal through at least one passage in a nosepiece of refractory material inserted toward the entrance of the continuously moving mold region and mating with the continuously moving mold surfaces with clearance gaps therefrom of less than 0.050 of an inch (1.27 mm), introducing the molten metal to be cast through at least one passage in at least one part of the inserted nosepiece; simultaneously injecting inert gas directly through at least one additional passage in at least one part of said nosepiece for introducing the inert gas directly into the controlled cavity in the entrance end of the mold region for enhancing the qualities and characteristics of the metal product being continuously cast.

The invention in additional aspects comprises those features or aspects described in the above two paragraphs including feeding inert gas through at least one passage in at least one of the nosepiece support structures while simultaneously also feeding inert gas through at least one passage in the nosepiece itself.

In another of its aspects, the invention comprises placing a shield member or structural member relatively near to at least one of the moving mold surfaces where it is travelling toward the entrance to the moving mold region and applying inert gas to the channel thus defined close to this moving mold surface for causing the moving mold surface to become bathed in the inert gas for carrying or propelling the inert gas through the clearance gap by the nosepiece and into the entrance to the moving mold region.

In additional aspects, the present invention comprises placing a shield member or structural member relatively near to at least one of the moving mold surfaces where it is travelling toward the entrance to the moving mold region for casting a relatively thin metal section and applying inert gas to the channel thus defined close to this moving mold surface for cleansing the mold surface for removing therefrom atmospheric gases and/or contaminating pollution gases and/or water vapor which may be carried by or adherent to the moving mold surface for enhancing the qualities and characteristics of the continuously cast metal product of relatively thin section being cast.

Among other aspects of the present invention are feeding of inert gas through passageways and/or chambers associated with support structure for the metal feeding nosepiece for applying this gas forwardly against the moving mold surfaces as they are travelling in converging relationship toward the entrance of the moving mold for casting a relatively thin metal section. Moreover, such passageways and/or chambers may include outlets directed laterally toward the respective moving edge dams employed in the twin-belt casters for bathing, enveloping and cleansing these moving edge dams with inert gas as they are approaching the moving mold.

Among the many advantages provided by the illustrative methods and apparatus described herein in certain aspects are those resulting from the fact that inert gas can be introduced directly into any cavity existing in the upstream portion of a moving mold casting a relatively thin metal section in generally horizontal or downwardly inclined orientation for establishing an inert gas pressure in such cavity slightly exceeding atmospheric pressure for shrouding the cavity itself and for causing the inert gas to flow outwardly in back-flushing, cleansing, bathing relationship through clearance gaps between the moving mold surfaces and the inserted metal-feeding nosepiece. Moreover, the inert gas is introduced through at least one passage in the refractory material of the nosepiece itself while molten metal is in-feeding through at least one other passage in the nosepiece. The outlet of the gas passage may be elevated above the centerline of the nosepiece for assuring that the inert gas is entering any cavity in the upstream portion of the moving mold above the level of the molten metal therein.

Among the many advantages provided by the illustrative methods and apparatus described herein in certain aspects are those resulting from the fact that the inert gas can be introduced indirectly into any cavity existing in the upstream portion of a moving mold casting a relatively thin metal section in generally horizontal or downwardly inclined orientation by applying the inert gas to at least one of the moving mold surfaces while said surface is travelling toward the entrance to the moving mold. The inert gas is introduced gently through passages and/or chambers in the support structure for the refractory nosepiece feeding the molten metal, and at least one shield member may be conformed in configuration relatively near to the moving mold surface for achieving effective application of the inert gas to the moving mold surface and for causing a diffusing, enveloping, cleansing action of the inert gas against the moving mold surface.

A further aspect of the present invention in those installations wherein inert gas is indirectly introduced into the mold through clearance gaps around the nosepiece will now be described. This aspect is the simultaneous, advantageous use of two kinds, two densities, of inert gas at the same time. Specifically, an inert gas which is heavier than air is applied above the nosepiece; such gas will tend to lie down upon the nosepiece and its upper support structure rather than to dissipate At the same time, an inert gas which is lighter than air may be applied below the nosepiece; such gas will tend to rise and to lie up against the bottom of the nosepiece and its lower support structure rather than to dissipate. As an illustration, a suitable heavier-than-air gas for top use is argon, which is about 35 percent heavier than air. A suitable lighter-than-air gas for bottom use is nitrogen, which is about 3 percent lighter than air.

BRIEF DESCRIPTION OF THE DRAWINGS

The invention, together with further objects, aspects, advantages and features thereof, will be more clearly understood from a consideration of the following description taken in conjunction with the accompanying drawings, in which like elements will bear the same reference designations throughout the various Figures. Open arrows drawn therein indicate the direction of movement of the metal being fed into the moving mold and being cast therein in a direction from upstream to downstream, the metal being fed into the upstream end of the continuously moving mold. The drawings are not necessarily to scale, emphasis instead being placed upon illustrating the principles of the invention.

FIG. 9 shows a gas-sealing-shroud funnel and gas-shield-channel assembled together with a metal-feeding assembly for continuously casting higher-melting-point metal, while applying inert gas with "open pool" metal in-feed.

DESCRIPTION OF THE PREFERRED EMBODIMENTS

Figure 1:
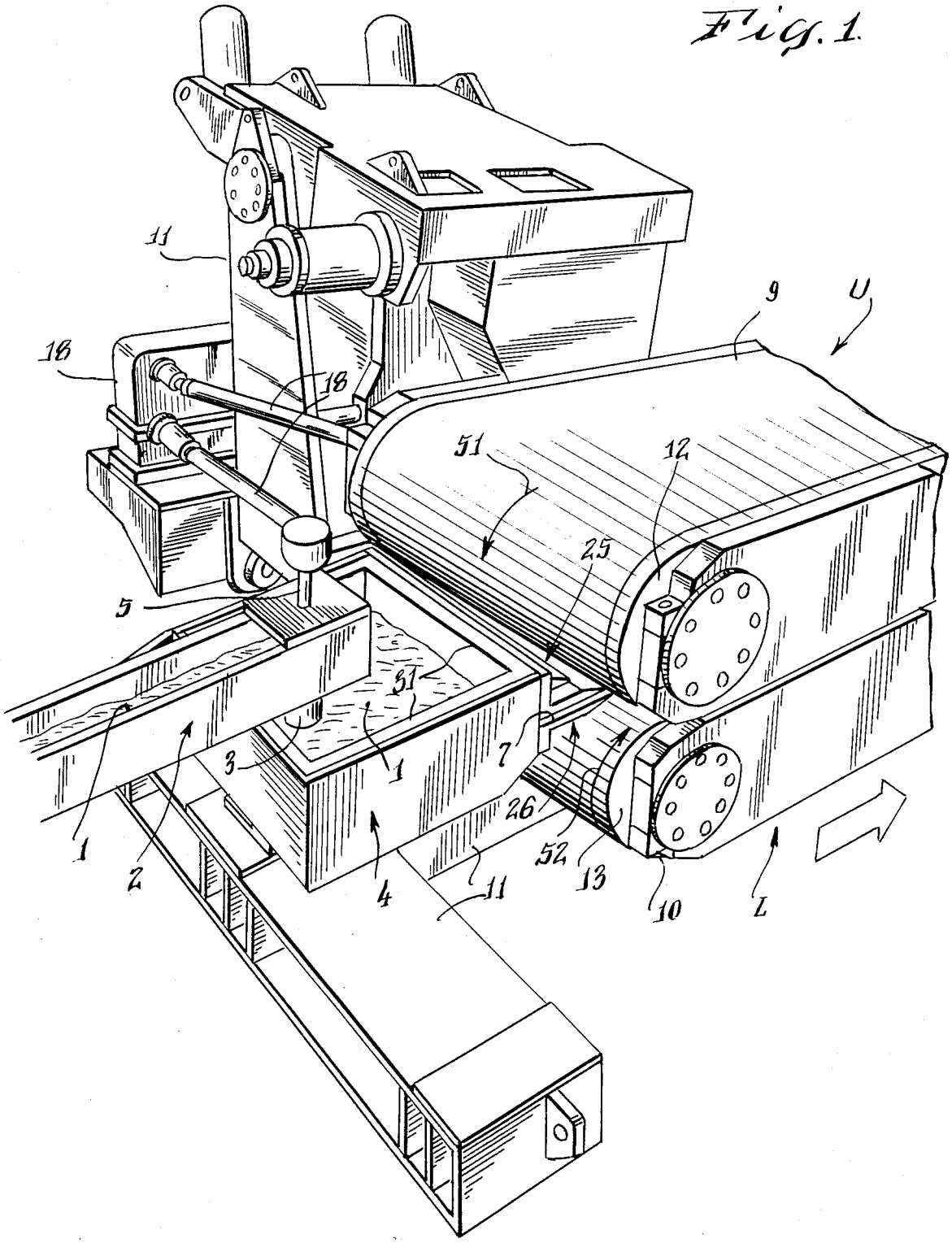
FIG. 1 is a perspective view of the input or upstream end of a continuous casting machine embodying the present invention, as seen looking toward the machine from a position upstream of, and outboard beyond the outboard side of, the two belt carriages.
Figure 2:
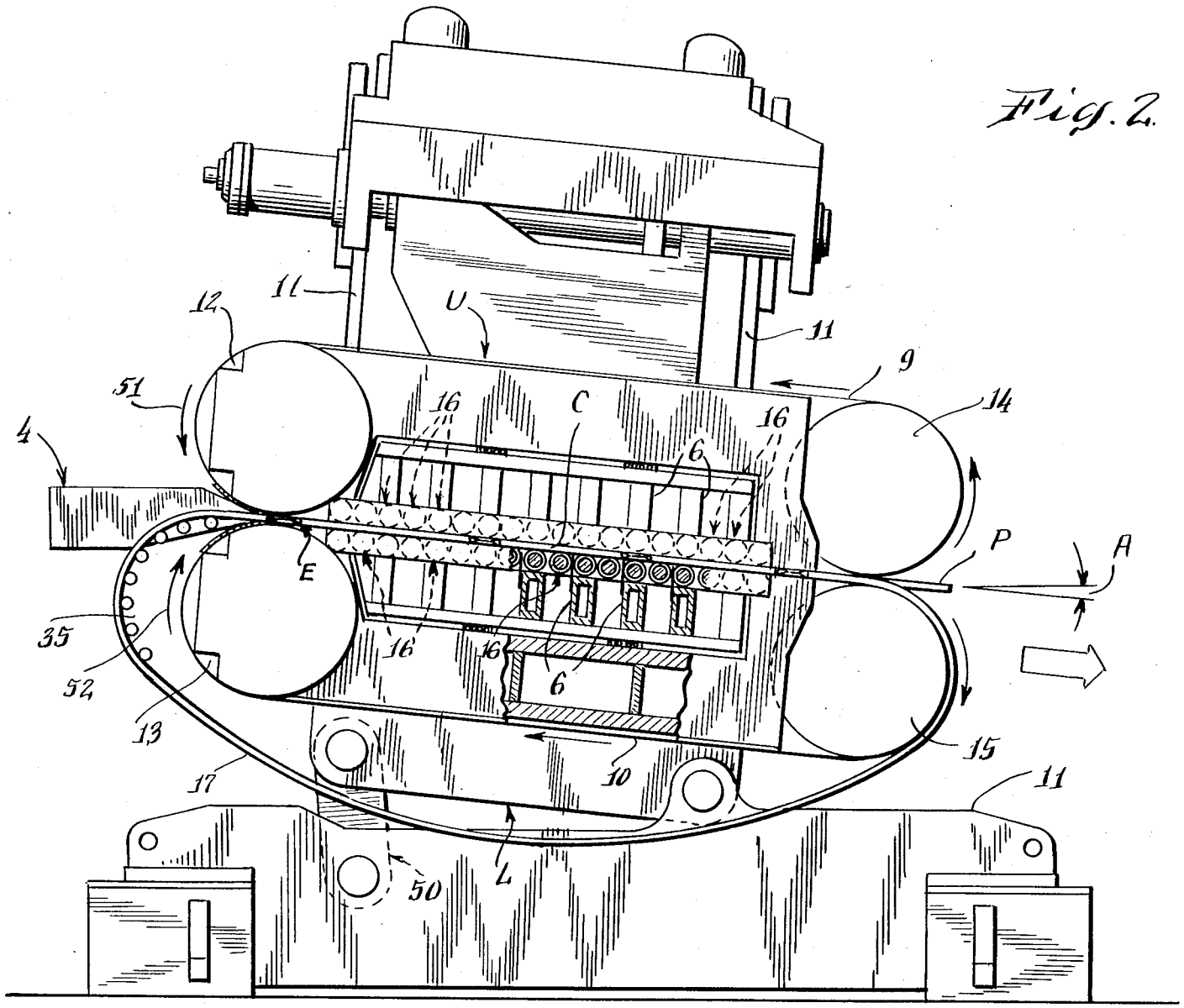
FIG. 2 is an elevational view, partly broken away and in section, of a casting machine embodying the present invention as seen looking toward the outboard side of the two belt carriages, showing the casting region downwardly inclined at a predetermined angle of inclination.

An illustrative example of a continuous metal casting machine in which the present invention may be used to advantage is shown in FIGS. 1 and 2. In this casting machine, molten metal 1 is supplied through in-feed apparatus which may be a pouring box, ladle or launder 2, and flows down through a pouring spout 3 in under-pouring relationship into a tundish 4, which is lined with a suitable refractory material 31. For clarity of illustration, the tundish is shown slightly withdrawn in FIG. 1 from the entrance to the moving mold. The rate of flow from the launder which is shown at 2 to the tundish 4 is controlled by a tapered stopper (not shown), mounted on the lower end of a control rod 5. From the tundish 4, the molten metal 1 is fed through a nozzle or nosepiece 7 of refractory material, or through tubes 21 (FIG. 7) into the entrance E of the moving mold or casting region C. This entrance E is at the upstream end of the casting region C, which is formed between spaced and substantially parallel surfaces of upper and lower endless flexible casting belts 9 and 10, respectively. The casting belts are normally made of low-carbon, cold-rolled strip steel of uniform properties, and welded by TIG welding. They are normally grit-blasted for roughening the surface which will face the molten metal, followed by roller-levelling coating.

The casting belts 9 and 10 are supported on and driven by respective upper and lower carriages, generally indicated at U and L. Both carriages are mounted on a machine frame 11. Each carriage includes two main rolls or pulleys which directly support, drive, and steer the casting belts. These pulleys include upper and lower input or upstream pulleys 12 and 13, and upper and lower output or downstream pulleys 14 and 15, respectively.

The casting belts 9 and 10 are guided by multiple finned backup rollers 16 (FIG. 2), so that the opposed belt casting surfaces are maintained in a preselected relationship throughout the length of the casting region C. These finned backup rollers 16 may be of the type shown and described in U.S. Pat. No. 3,167,830.

A flexible, endless, side metal-retaining dam 17, sometimes called a moving edge dam, is disposed on each side of the casting region and for confining the molten metal. The side dams 17 (only one is seen in FIG. 2) are guided at the input or upstream end of the casting machine by guide members 35, shown in part, which are mounted on the lower carriage L, for example, such as are shown in said U.S. patent, or in U.S. Pat. No. 4,150,711.

During the casting operation, the two casting belts 9 and 10 are driven at the same linear speed by a driving mechanism 18 which, for example, is such as described in said U.S. Pat. No. 3,167,830. As shown in FIG. 2, the upper and lower carriages U and L are downwardly inclined in the downstream direction, so that the moving mold casting region C between the casting belts is inclined at an angle A with respect to the horizontal. This downward inclination A facilitates flow of molten metal into the entrance E of the casting region C. This inclination angle A is usually less than 20°, and it can be adjusted by a jack mechanism 50. The presently preferred inclination for aluminum and its alloys is in the range from 6° to 9°.

Intense heat flux is withdrawn through each casting belt by means of a high-velocity moving layer of liquid coolant, applied from nozzle headers 6 and travelling along the reverse, cooled surfaces of the upper and lower belts 9 and 10, respectively. The liquid coolant is applied at high velocity, and the fast-flowing layer may be maintained in a manner as shown in said U.S. Pat. No. 3,167,830 and in U.S. Pat. No. 3,041,686. The presently preferred coolant is water with rust inhibitors at a temperature in the range from 70° F. (21° C.) to 90° F. (32° C.).

After the cast product P has solidified at least on all of its external surfaces, and has been fed out of the casting machine, it is conveyed and guided away by a roller conveyor (not shown).

Figure 5:
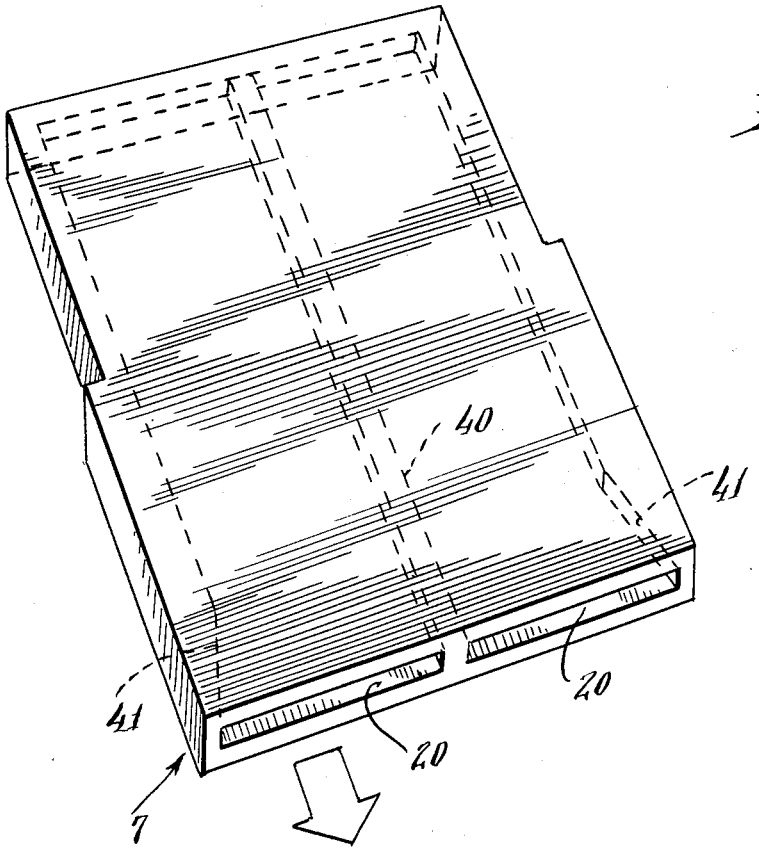
FIG. 5 is a perspective view of a refractory metal-feeding nosepiece, or one section of a wide nosepiece, this configuration being especially suitable for in-feeding molten metals in the lower range of melting points.
Figure 6:
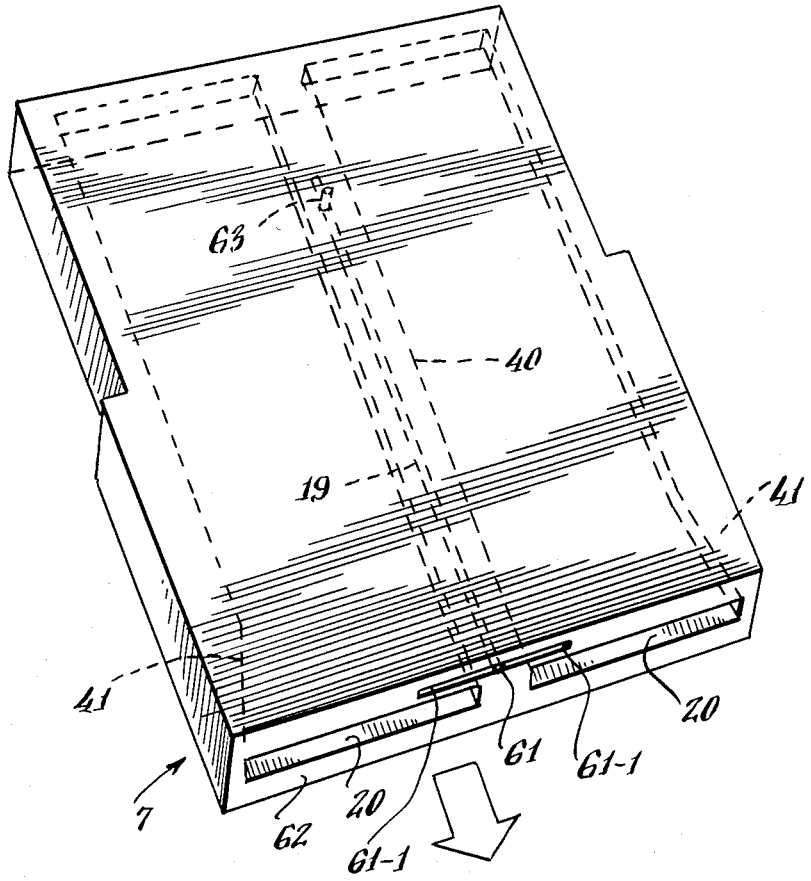
FIG. 6 is a perspective view of a nosepiece as illustrated in FIG. 5 which has a passage therein for the introduction of inert gas directly into the cavity in the entrance portion of the moving mold.

For in-feeding metals of low melting point, for example, lead, zinc, or aluminum, the nosepiece may be made of marinite or other suitable refractory material. This nosepiece 7 is made of one integral piece of refractory material as shown in FIGS. 5 and 6. Alternatively, this nosepiece 7 may be assembled from a plurality of integral pieces of refractory material.

The term "nosepiece" as used throughout may refer to a single integral member or to an assembly of a plurality of integral pieces.

In order to support this refractory nosepiece 7, there are rigid upper and lower support structures 25 and 26, respectively, positioned above and below the nosepiece 7 in the manner of clamps with the nosepiece sandwiched between these clamping structures 25 and 26.

As shown in FIGS. 5 and 6, the refractory nosepiece 7 includes at least one metal feeding passage 20. In this example, there are two such passages 20 shown extending in parallel relationship in the downstream direction longitudinally through the nosepiece 7 with a central barrier wall 40 between them. These metal feeding passages 20 have a rectangular cross section. They are relatively wide with shallow vertical dimension as is appropriate for casting relatively thin metal sections. In order to distribute the in-feeding molten metal smoothly and quietly, without undue turbulence, into the moving mold C (FIGS. 2 and 3) the downstream ends of these metal feeding passages 20 are shown flared out gradually laterally in the downstream direction as indicated at 41 (FIGS. 5 and 6).

Figure 3:
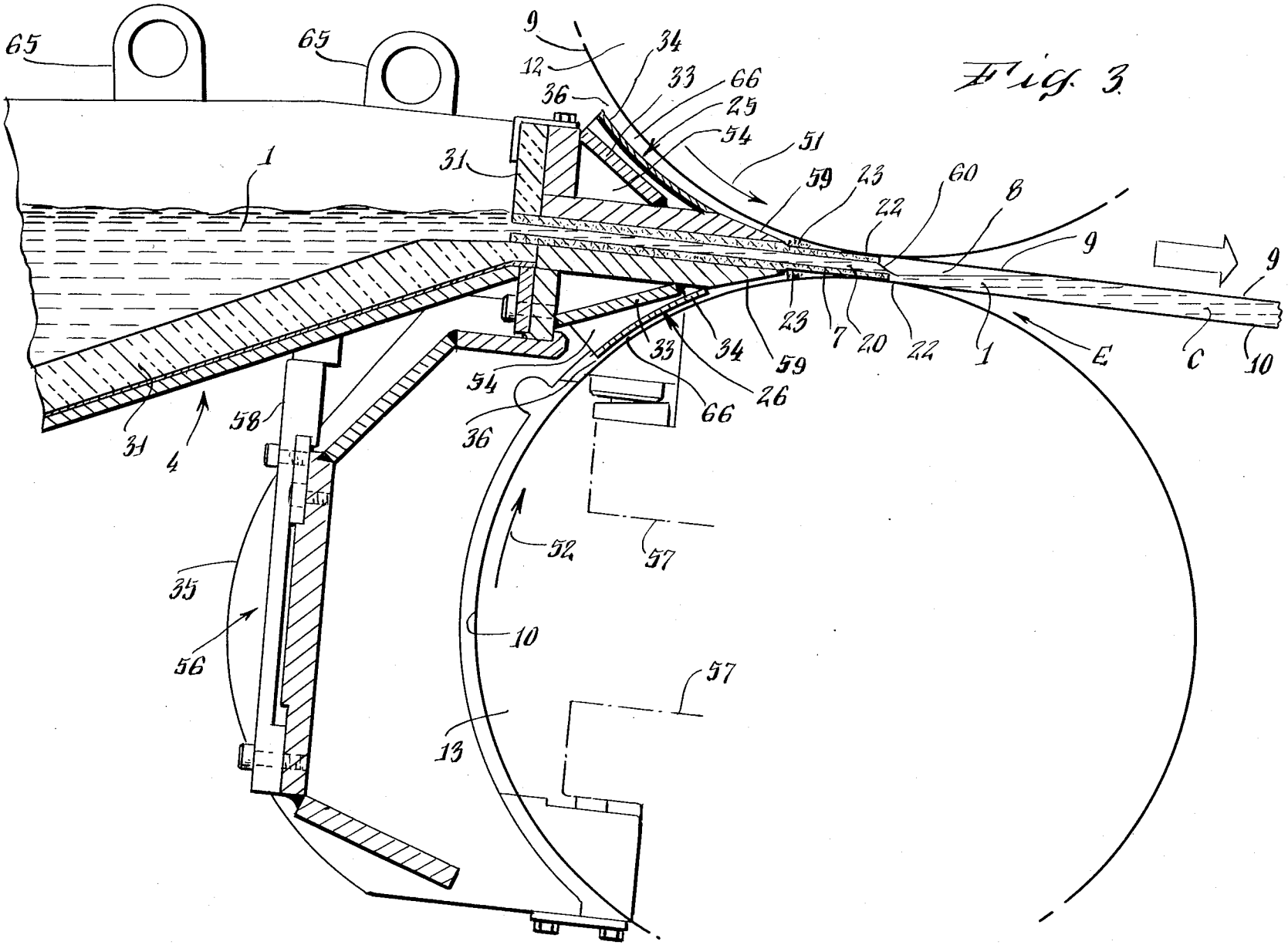
FIG. 3 is a sectional elevational view of the upstream or feeding end of this machine, shown enlarged, equipped with a semi-sealing nosepiece for casting a relatively thin metal section while applying inert gas, the configuration shown being especially suitable for metals of the lower range of melting points.

As seen in FIG. 3, the upper and lower supporting structures 25 and 26 for clamping the refractory nosepiece 7 between them are generally similar in construction, except that the lower one is inverted in configuration. These supporting structures 25 and 26 are rigid, for example, being made of steel.

Figure 4:
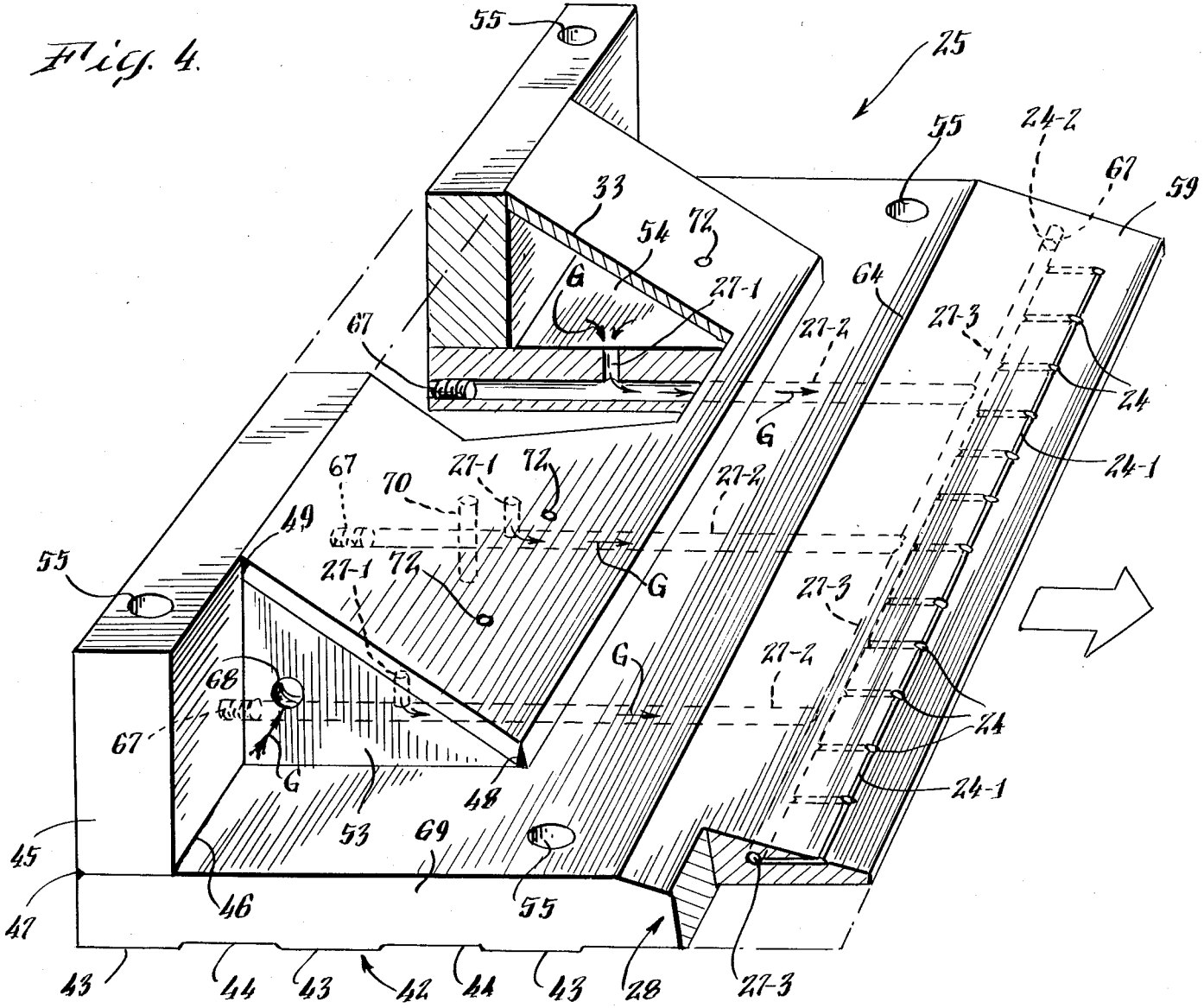
FIG. 4 is a perspective view, shown enlarged, of one of a pair of structural support clamps for the refractory nosepiece; the clamp is arranged for the distribution of inert gas, by applying said inert gas at one of the clearance gaps at close range.

In FIG. 4 is shown enlarged the upper support clamp structure 25. This structure includes a rigid base plate 28 whose clamping surface 42 includes shallow transversely extending lands 43 and grooves 44 for securing a firm clamping engagement with the refractory nosepiece 7. There is an upstanding rigid rear flange or wall 45 attached to the base plate 28, for example, by welding at 46 and 47. The assembly of this base plate 28 and rear wall 45 is stiffened by a diagonal plate 33 welded at 48 and 49, respectively, to the base plate and rear wall. As seen in FIG. 3, the slope of this diagonal plate 33 generally conforms to the configuration of the nearby upper casting belt 9 where this belt is curved and travelling (arrow 51) around the upper input pulley roll 12. In other words, this diagonal plate 33 is sloped to be generally parallel to an imaginary plane tangent to the nearest region of the cylindrically curved belt 9.

There is a triangular side wall 53 (FIG. 4) secured in gas-tight relationship to the baseplate, rear wall and diagonal plate 33 and a corresponding triangular side wall (not seen) at the other side of the support clamp structure 25 thereby forming a "lean-to" plenum chamber 54. A portion of the structure 25 is shown cut away to reveal clearly this lean-to chamber 54, and there is a similar "lean-to" plenum chamber 54 in the lower clamp structure 26. Sockets or mounting holes 55 are provided in this clamp structure 25 for attachment to mounting brackets 56 (FIG. 3) which are mounted on upstream end portions 57 of the main frame members of the lower carriage L. The tundish 4 is shown supported by a bar 58 extending from the bracket 56, and other support mounting means 65 for the tundish may be provided.

In order to conform with the nearby curved moving mold surface 9, the forward (downstream) edge or lip of the base plate 28 is chamfered at 59 at a slope less steep than the diagonal plate 33. As seen in FIG. 3, this sloped lip 59 is generally parallel with an imaginary plane tangent to the nearby curved moving mold surface 9.

FIG. 3 shows the molten metal exiting at 60 from the passage 20 in the nosepiece 7 and entering the entrance region E of the moving mold casting region C. A resultant gas space or cavity 8 thereby exists in the entrance region E above the level of the molten metal in the moving mold region C adjacent to the downstream end of the nosepiece 7.

In order to introduce inert gas directly under pressure into this cavity 8 for controlling the gas content therein, the nosepiece 7 is provided with at least one longitudinally extending gas feed passage 19 (FIG. 6) running along side of the metal feeding passages 20. This gas feed passage 19 is located in the center portion 40 of the refractory material in the nosepiece. This gas feed passage 19 is located at a level above the centerline of the nosepiece 7 and its outlet 61 is near the upper edge of the downstream end or terminus 62 of the nosepiece. The way in which the inert gas is fed down into the vertical inlet port 63 connecting with the gas feed passage 19 will be explained later.

By virtue of having this gas feed outlet 61 at this elevated location on the nozzle terminus 62, the gas flow is generally above the level of the molten metal exiting 60 (FIG. 3) from the in-feed passages 20. Thus the inert gas enters directly into the cavity 8 for maintaining this cavity charged with inert gas at a pressure slightly above atmospheric pressure. Even if the level of the molten metal in the entrance region E is temporarily inadvertently allowed to rise up slightly above the level shown in FIG. 3, the elevated position of the gas feed outlet 61 will usually place it above the metal, so that it will usually remain unblocked by the molten metal in the entrance E and, therefore, be in continuous communication with the controlled gas cavity 8. The gas feed outlet 61 is shown connected with a horizontally extending transverse narrow groove or slot 61-1 cut into the terminus 62 of the refractory nosepiece 7 for aiding in distributing the inert gas directly into the controlled gas cavity 8 at low velocity with minimum resulting agitation or turbulence of the molten metal. The cavity 8 thus remains controlled by continuous in-feed of inert gas through one or more passages 19 at a pressure slightly above atmospheric pressure. Invasion into the cavity 8 of undesirable gases, particularly oxygen and water vapor (and also atmospheric polluting gases, such as sulphur dioxide and carbonic acid gas) is prevented by this inert gas being continuously charged into this cavity. The inert gas shrouds this cavity 8 and purges and thereafter excludes the undesirable gases from the entrance region E.

A constant flow of inert gas is maintained through the gas feed passage 19 during casting, maintaining the cavity 8 full of inert gas slightly above atmospheric pressure. As discussed in the introduction, there are slight clearance gaps above and below at 22 (FIG. 3) between the downstream end of the nosepiece 7 and the upper and lower mold surfaces 9 and 10 which are continuously moving as indicated by the arrows 51 and 52. In this casting machine these moving mold surfaces 9 and 10 are formed by the casting belts. Some of this constant flow of inert gas exits in the upstream direction through the aforementioned narrow clearance gaps at 22. These clearance gaps 22 are less than 0.050 of an inch (1.27 mm) and are usually in the range of 0.010 of an inch (0.25 mm) to 0.020 of an inch (0.5 mm). The inert gas exiting through these clearance gaps 22 around the nosepiece 7 advantageously scours, cleans, and displaces atmospheric gases, including water vapor, off from the incoming mold surfaces 9 and 10 and flushes the gases away from the entrance region E.

The above-described close-flowing, displacing, enveloping, cleansing action on the moving mold surfaces is enhanced and extended over a wide area of the moving mold surfaces 9 and 10 as they converge 51, 52 toward the entrance region E by forming a narrow channel 66 for confining the exiting inert gas close to these moving mold surfaces 9 and 10 by means of curved shield members 34 (FIG. 3) positioned between the diagonal plates 33 and the moving mold surfaces. The shield members 34 are cylindrically curved for nesting close to the respective curved moving mold surfaces 9 and 10, being spaced less than ¼ inch (6 mm) and preferably at close proximity within ⅛ inch (3 mm) from these moving surfaces. The forward (downstream) edge of the curved shield member 34 is welded along the crest 64 (FIG. 4) of the base plate 28 near the upstream border of the chamfered lip 59. The inert gas exits at 36 (FIG. 3) from the narrow channel 66 between the shield 34 and the closely proximate moving mold surface 9 or 10 after flowing through this narrow channel in a direction counter to the motion 51 or 52 of the moving mold surface in close-flowing, displacing, cleansing relationship therewith.

The use of the shield members 34 advantageously reduces the consumption of inert gas and also increases the time duration of exposure of the moving mold surfaces 9, 10 to the inert gas for displacing, cleansing of atmospheric gases therefrom.

If desired to increase further the impedance against invasion or intrusion of atmospheric gas into the entrance region E, a loose, flexible packing material 23 may be placed in this narrow channel 66. A suitable loose, flexible packing, for example, is fiberglass insulation or "Kaowool" ceramic insulation, obtainable from Babcock & Wilcox. This loose packing may be allowed only lightly to contact the moving mold surfaces 9, 10. It may be placed in the channel 66 and/or adjacent to the forward edge of the sloping lip 59 against the nosepiece 7, as shown at 23. This loose packing 23 may be used only with the "direct" in-feeding of inert gas into the cavity 8 through passages 19 (FIG. 6) in the nosepiece 7.

There is evidence that some atmospheric oxygen and other atmospheric gases, such as water vapor, are adsorbed upon the moving mold surfaces 9, 10 and/or upon their coatings, for example, such coatings as described and claimed in U.S. Pat. No. 3,871,905. Again, with the use of moving mold surfaces 9, 10, which have been roughened, as by grit-blasting, atmospheric oxygen and other gases tend to be entrained in the resulting minute dimples. Also, in addition to adsorption, rough coatings on the moving mold surfaces 9, 10 can entrain atmospheric gases. The adsorbed and/or entrained atmospheric gases would be carried or conveyed continuously into the moving mold with consequent adverse effects upon the metal product P being cast, except for the advantageous scouring, diffusing, and displacing action upon the moving mold surfaces 9, 10 caused to occur by the inert gas as described above.

In addition to exiting in a diffusing, scouring action on the moving mold surfaces 9 and 10, some of the inert gas exits from the pressurized controlled gas cavity 8 by flowing out laterally to each side past the respective moving edge dams 17, thereby scouring and displacing atmospheric gases off from these edge dams and excluding such gases from invasion into the entrance region 8.

This inert gas is often nitrogen, but it may be argon, carbon dioxide, or other gas which is appropriately inert and non-reactive in relation to the particular metal or alloy 1 being cast. The inert gas which can be used to advantage when casting aluminum and aluminum alloys is pre-purified nitrogen that has been water-pumped, i.e., pumped with water sealing in the compressors and known as "dry" nitrogen, as distinct from oil-pumped nitrogen. This "dry-pumped" nitrogen is ordinarily sold to welders as shielding gas. A typical specification (for such nitrogen shielding gas) calls for less than two parts per million of oxygen, and less than six parts per million of water.

This in-feeding of inert gas through one or more passages 19 in the refractory nosepiece 7 with outlet 61 communicating directly into the controlled gas cavity 8 is called the "direct" injection of inert gas. A further advantageous effect of this direct charging of the cavity 8 with the inert gas is to dilute and expel away from the entrance region E any oxygen, water vapor or other deleterious or contaminant gases which may be evolved or given off by the mold and nozzle components in the presence of tremendous heat release occurring from the entering flow 60 of the molten metal.

In order to properly control and exclude troublesome atmospheric gases more is required than the direct injection of inert gas into the cavity 8 per se; that is, the moving mold surfaces 9, 10 should also be enveloped and cleansed by upstream flowing gas channeled 66 in close proximity to the moving mold surfaces by the curved shields 34 as described above.

In addition to this direct injection, or as an alternative thereto, an advantageous "indirect" in-feeding of the inert gas may also be employed. Inviting attention to FIG. 4, it is seen that the inert gas G enters a supply port 68 in the triangular end wall 53 for feeding the inert gas G into the lean-to plenum supply chamber 54. This supply port 68 is threaded for a connection fitting to a gas feed pipeline or flexible conduit (not shown). From this chamber 54 the gas G flows as indicated by arrows through a plurality of vertical passages 27-1 into respective long bored passages 27-2 extending horizontally downstream in the base plate 28 connecting to a transversely bored header passage 27-3 connecting with multiple small orifices 24 in the chamfered lip 59 of the base plate 28. The upstream end of each longitudinally drilled passage 27-2 is closed by a plug 67. Each end of the transversely drilled header passage 27-3 is closed by a plug 67.

If it is desired that some of this inert gas G in the header passage 27-3 be applied laterally to the edge dams, then an orifice 24-2 is drilled in each of the latter two plugs 67. For casting up to approximately 1 inch (25 mm) thick, it is usually not necessary to provide lateral flow orifices 24-2. Up to that thickness, sufficient pressure can usually be maintained in the controlled gas cavity 8 to move the inert gas out laterally against the moving edge dams 17 and upstream along the vertical side surfaces 69 of the base 28 at a sufficient flow rate and volume that atmospheric gases cannot intrude into the mold entrance region E.

Inert gas issuing through the orifices 24 in the sloping lip surface 59 is advantageously applied to the moving mold surfaces 9 and 10 at close range for gently, noiselessly, covering, blanketing, enveloping and cleansing them. If the direct in-feed gas passages 19 are omitted from the nosepiece 7, as shown in FIG. 5, then the motion 51, 52 (FIG. 3) of the mold surface 9, 10 carries and propels some of this inert gas into the cavity 8. An advantageous arrangement is to drill the orifices 24 in a horizontal row spaced one inch apart (25 mm) in a center-to-center distance and each having a relatively small diameter, for example, of 0.062 of an inch (1.6 mm). In continuous casting of aluminum and aluminum alloys using the "indirect" in-feeding of "dry-pumped" nitrogen as the inert gas G through passages 27-1, 27-2, 27-3 and orifices 24, the flow rate that has been successfully used is 10 cubic feet (0.28 cubic meter) per hour for a cast width of 14 inches (355 mm), and a cast thickness up to 1 inch (25 mm). This ten cubic feet per hour is the volume of inert gas at atmospheric pressure and at room temperature. The corresponding calculated velocity of noiseless ejection of inert gas from the orifices 24 is approximately 5 feet per second (1.5 meters per second). The corresponding pressure above atmospheric pressure in the lean-to plenum supply chamber 54 is, we believe, below 0.01 pounds per square inch (under 0.07 kilopascals). Given the proportions of the orifices 24, we have the theory this low flow falls within the region of fluid-flow parameters in which laminar flow prevails, as opposed to turbulent flow. Laminar flow is by definition non-turbulent flow, which non-turbulence is a necessity for avoiding the entrainment of air. The turbulence and disturbance noise associated with too high a flow rate will entrain air; such air entrainment being undesirable. Regardless of whether our theory that laminar flow is prevailing is correct or not, the employment of this invention, as described, will achieve the advantageous results described in continuously casting aluminum and aluminum alloys and will be beneficial in continuously casting other metals in a substantially horizontal or downwardly inclined continuous machine where oxidation or contamination of the cast product by atmospheric gases is a problem.

In order to reduce the possibility of turbulence as the inert gas issues through the orifices 24 for reducing any tendency to entrain air, these orifices can be terminated in a transverse slot or groove 24-1 milled into the sloping surface 59.

As the inert gas is expelled from the multiple orifices 24, it slows down and thus evidently creates a continuous zone or "ridge" of minute pressure in the cusp region between the moving mold surface 9 or 10, the sloping lip 59 and the forward (downstream) end of the nosepiece. This slowing down and creating of the pressure ridge is aided and abetted by culminating the orifices 24 in the transverse slot or groove 24-1. Some of the gas from this pressure ridge flows through the clearance gap 22 into the controlled gas cavity 8. The remainder of the inert gas from this pressure ridge flows upstream; that is, flows out through the channel 66 in the close-flowing, displacing, cleansing action, as described above, exiting at 36.

This "indirect" method of applying the inert gas quietly; that is, noiselessly with no audible disturbance into the entrance E to the moving mold, by forming the pressure ridge in the cusp region near the nosepiece, as described above, is the preferred method for producing aluminum cast product P and alunimum alloy cast product P and especially for producing aluminum alloy cast products P containing magnesium, even relatively high percentages of magnesium, that are attractively free from undesirable and troublesome surface oxide and have acceptable qualities and characteristics on the surfaces and also in the interior.

The simultaneous use of both the "direct" and "indirect" methods of introducing the inert gas can be used to advantage. For example, when the molten metal in the entrance E to the moving mold can be anticipated to rise to a level sufficient to cover at least the lower clearance gap 22 (FIG. 3 or 8) at the nosepiece, then this lower clearance gap 22 is appropriately shrouded and controlled by the "indirect" introduction of inert gas through the lower lean-to plenum chamber 54 and communicating gas-feed passages in the lower clamp structure 26. Such gas-feed passages in the lower clamp structure 26 are similar to those shown in FIG. 4 in the upper clamp structure 25. Thus, the lower clearance gap 22 (FIG. 3 or 8) is being shrouded and controlled by the "indirect" method, while the upper clearance gap 22 is simultaneously being controlled and shrouded by the "direct" injected inert gas thereafter flowing upstream out of the cavity 8 through the upper clearance gap 22 (FIG. 3 or 8) and upstream through the upper close-flowing channel 66.

With reference to FIGS. 6 and 4, the inert gas is fed into the inlet port 63 leading to the passage 19 by drilling a passage 70 leading from the slightly pressurized plenum chamber 54 through the base plate 28 and through one of the lands 43 in alignment with and in communication with the inlet port 63.

If desired to augment the quiet, unturbulent flow of the inert shrouding gas in the vicinity of the nosepiece clamp support structures 25 and 26, additional outlet orifices 72 may be drilled through the diagonal plate 33 into the pressurized lean-to plenum chamber 54.

Figure 7:
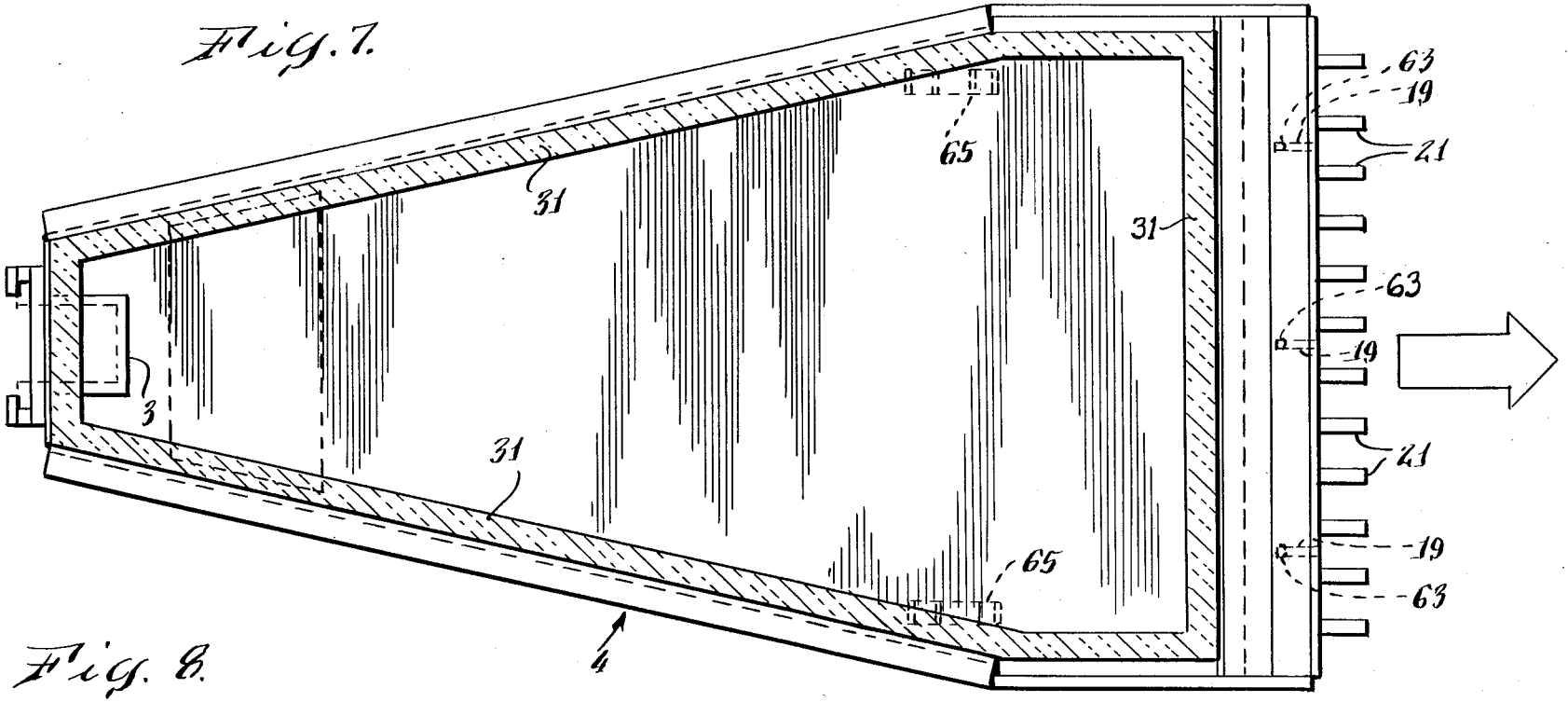
FIG. 7 is a plan view of a tundish especially suitable for in-feeding molten metals of higher melting point.
Figure 8:
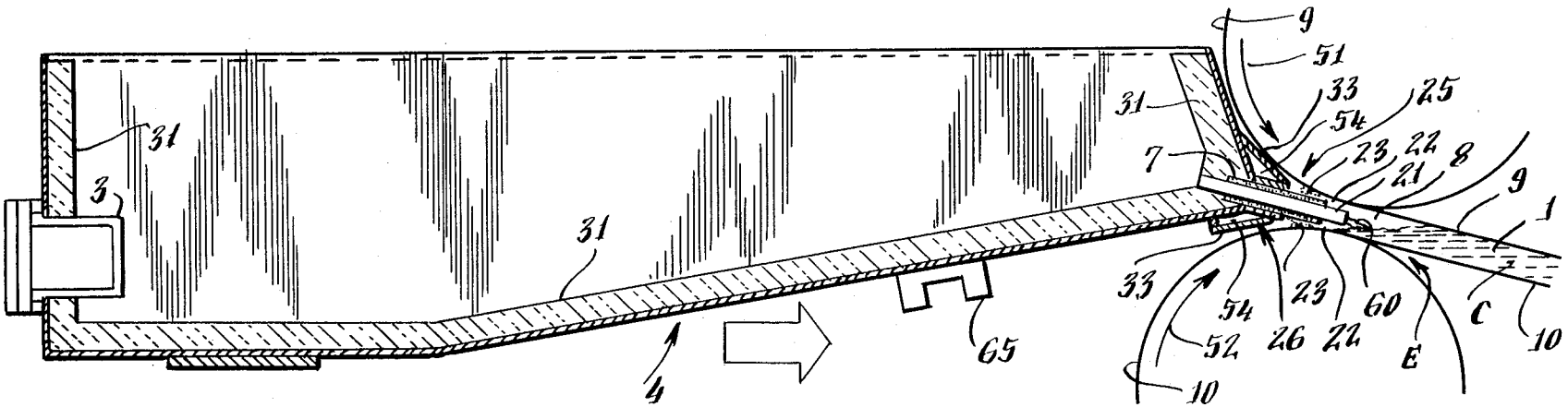
FIG. 8 is a sectioned elevational view of the tundish of FIG. 7 in relation to the upstream or feeding end of a continuous casting machine for casting a relatively thin metal section while applying inert gas.
Figure 9:
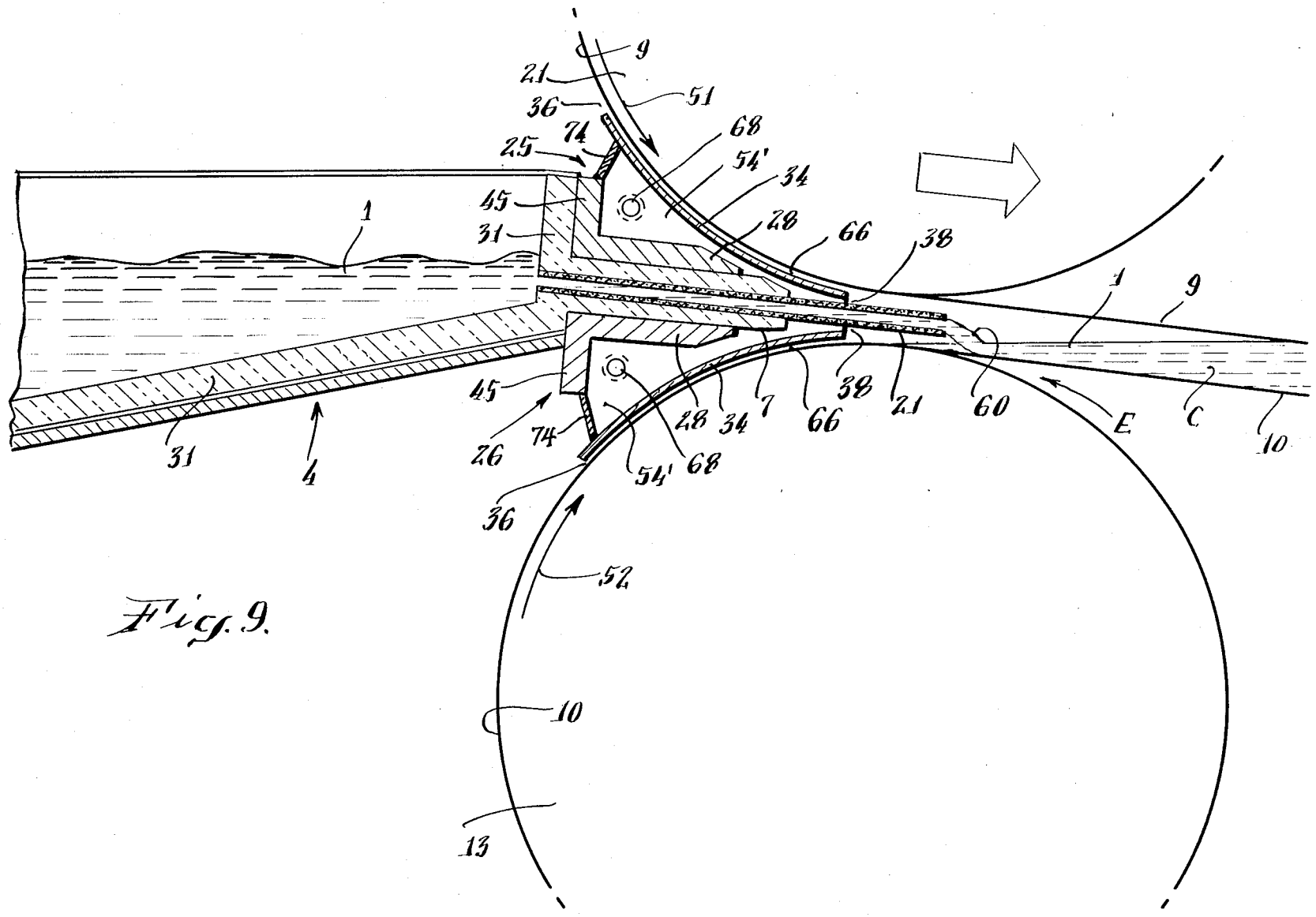
FIG. 9 is a sectioned elevational view generally similar to FIG. 3.

When casting metals of high melting temperature, for example, copper, iron and steel, the moving mold surfaces 9 and 10 are covered with appropriate coating, for example, coatings of silicone oil type or an alkyl oil type, such as UCON LB-300X obtainable from Union Carbide Corporation, which may be used with or without admixtures of graphite. With metals of such high melting temperature, it is usually advantageous to use a nosepiece 7 with a plurality of parallel, reinsertable pouring nozzles or tubes 21 in conjunction with a tundish 4 as shown in FIGS. 7, 8 and 9. These reinsertable tubes 21 are inserted into the nosepiece 7 to communicate with the molten metal in the tundish 4, as seen most clearly in FIG. 9. These tubes 21 are made of high temperature resistant refractory material, for example, fused silicon dioxide (quartz), titanium dioxide, aluminum oxide, or high temperature refractory nitride materials, all of which are commercially available in the form of tubes. The tubes 21 are embedded in parallel holes in the accurately machined nosepiece 7.

A plurality of parallel in-feed gas passages 63 and 19 analogous to the arrangement shown in FIG. 6 are drilled in the nosepiece 7 for the injection of inert gas G directly into the controlled gas cavity 8 (FIG. 8). This inert gas comes from the pressurized lean-to plenum chamber 54 (see also FIG. 4) through appropriately located supply passages 70 communicating with the respective vertical passages 63. The clearance gaps adjacent to the downstream end of the nosepiece 7 are shown at 22.

In order to isolate the controlled gas cavity 8 from atmospheric gases and provide further impedance to intrusion of such gases, a loose flexible packing seal 23, as described above, is placed above and below the nosepiece 7 adjacent to the downstream edge of the lip 59 (FIG. 4) of the baseplate 28 of the support clamp structures 25, 26. This packing 23 may be allowed to contact the moving mold surfaces 9 and 10.

In addition to the in-feed gas passages 19, inert gas may be fed into the narrow channels between the diagonal plates 33 (FIG. 8) and the moving mold surfaces 9, 10 by employing outlet orifices 72 (FIG. 4) in these diagonal plates. Although FIG. 8 does not show the curved shield members 34 (FIGS. 3 and 9), it is to be understood that such shields may be employed with the multi-tube 21 metal feed shown in FIGS. 7 and 8. Also, indirect feeding of inert gas through passages 27-1, 27-2, 27-3, 24 and 21-1 in the clamp structures 25 and 26 may be employed.

The methods of feeding the molten metal into the entrance E of the moving casting mold C, as shown in FIGS. 2, 3 and 8 are called "closed pool" feeding because the cavity 8 is essentially closed by the small clearance gaps 22 adjacent to the downstream end of the nosepiece 7, as described above.

An alternative method of feeding the molten metal, called "open-pool" feeding is shown in FIG. 9. While open-pool feeding involves no closely fitting nosepiece 7, its use is at times appropriate, particularly when casting thicker metal sections above 1½ inches (38 mm) in thickness. The inert gas is supplied through the supply ports 68 into "lean-to" chambers 54' of funnel-like configuration. These lean-to funnel chambers 54' are defined by the curved shield 34, the base plate 28 and rear wall 45 of the supporting clamp structure 25 or 26 and by a shield-supporting wall plate 74 welded between the rear wall 45 and the shield 34. The inert gas flows downstream from the funnel chamber 54' through the exit 38 adjacent to the downstream edge of the curved shield 34.

Some of this inert gas flows in shrouding relationship into the entrance region E of the moving casting mold C. Some of this inert gas returns upstream through the narrow channels 66 in cleansing relationship with the moving mold surfaces and then exiting from these channels at 36.

Although metal feeding through multiple reinsertable tubes 21 of high temperature refractory material (FIGS. 7, 8, 9) is described as being used for metals or alloys having high temperature melting points, such multi-tube feeding may also be used for low temperature melting point metals and alloys, if desired.

The results with any of the above-described methods and apparatus will be improved in the twin-belt casters by the concurrent use of belt preheating as described and claimed in U.S. Pat., Nos. 3,937,270 and 4,002,197 and/or by preheating the belts with steam closely ahead of the entrance E to the moving mold C, as described and claimed in copending application, Ser. No. 199,619, filed Oct. 22, 1980, and assigned to the assignee of the present invention.

The present invention improves the surface qualities and characteristics of continuously cast metal product P of relatively thin section when cast in approximately horizontal or downwardly inclined orientation mode, particularly of aluminum and its alloys, including high magnesium alloys thereof, and also provides improvement in the internal qualities and characteristics of such continuously cast metal products. This invention also improves the qualities of thicker continuously cast metal product P when cast in the horizontal mode or downwardly inclined mode.

As used herein, the term "downwardly inclined" means at an angle less than 45° with respect to the horizontal and usually less than approximately 20°.

Examples of aluminum alloys which can be continuously cast with advantage using the present invention are:

EXAMPLE 1

AA 1100 at casting speeds up to 1,400 pounds per hour per inch of width of the moving mold.

EXAMPLE 2

AA 3003 at casting speeds up to 1,400 pounds per hour per inch of width of the moving mold.

EXAMPLE 3

AA 3105 at casting speeds up to at least 1,000 pounds per hour per inch of width of the moving mold.

EXAMPLE 4

AA 7072 at casting speeds up to at least 1,000 pounds per hour per inch of width of the moving mold.

EXAMPLE 5

Alloys containing up to 2.8% Magnesium by weight at casting speeds up to 1,150 pounds per hour per inch of width of the moving mold.

EXAMPLE 6

Hard alloys containing up to 3.0% of Magnesium by weight at casting speeds up to at least 1,000 pounds per hour per inch of width of the moving mold.

EXAMPLE 7

Alloys containing up to 1.8% Magnesium at casting speeds up to at least 1,175 pounds per hour per inch of width of the moving mold.

EXAMPLE 8

Alloys similar to AA 3105, except containing 0.8% Manganese and 0.3% Magnesium by weight, at casting speeds up to at least 1,000 pounds per hour per inch of width of the moving mold.

EXAMPLE 9

Alloys containing 1.8% Magnesium, 0.3% Silicon, 0.3% Iron, and 0.52% Manganese by weight at casting speeds up to at least 1,000 pounds per hour per inch of width of the moving mold.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art in order to adapt the apparatus and methods of applying inert gas to particular casting machines without departing from the scope of the following claims.

We claim:

1. The method for continuously casting metal product directly from molten metal, wherein the molten metal is introduced into a moving mold whose downstream direction is approximately horizontal or downwardly inclined, said moving mold being defined between the mold surfaces of two opposed, cooled moving endless flexible casting belts and laterally defined by first and second travelling side dams, the method comprising:

inserting a metal-feeding nosepiece into the entrance to said moving mold and holding said nosepiece in position with clearance gaps of more than 0.010 of an inch (0.25 mm) and less than 0.050 of an inch (1.27 mm) between said nosepiece and said moving mold surfaces, providing at least one metal-feeding passage extending downstream in said nosepiece and feeding the molten metal through said metal-feeding passage into the entrance to said moving mold, providing at least one gas-feeding passage extending downstream in said nosepiece and feeding an inert gas through said gas-feeding passage at a pressure slightly exceeding atmospheric pressure directly into the entrance to said moving mold, said inert gas being inert and essentially non-reactive in relation to the metal being cast, maintaining the level of the molten metal in the entrance of the moving mold downstream from the metal-feeding passage in the nosepiece thereby creating a cavity in the entrance to the moving mold adjacent to the nosepiece, feeding the inert gas directly from said gas-feeding passage into said cavity for charging said cavity with the inert gas at a pressure exceeding atmospheric pressure for controlling the gas content of said cavity, and channeling the inert gas flowing out from the entrance to the moving mold through said clearance gaps to flow upstream in close proximity to the moving mold surfaces as they are approaching the entrance for causing said channeled gas to cleanse and displace atmospheric gases off from the respective moving belt surfaces before they enter the moving mold.

2. The method for continuously casting metal product as claimed in claim 1, including the further step of:

positioning the outlet of the gas-feeding passageway in said nosepiece above the level of the outlet of said metal-feeding passageway for introducing the inert gas directly into the controlled gas cavity above the level of the molten metal in the entrance to the moving mold.

3. The method for continuously casting metal product as claimed in claim 1, including the further steps of:

grooving the discharge end of the nosepiece with a groove extending horizontally transversely with respect to the direction of metal feed, and flowing the inert gas from said gas feed passage into said grooving for distributing the inert gas with at most little turbulence of the molten metal.

4. The method for continuously casting metal product of a thickness between ¼ inch (6 mm) and 1½ inches (38 mm) directly from molten metal, wherein the molten metal is introduced into a moving mold whose downstream direction is approximately horizontal or downwardly inclined, said moving mold being defined between the mold surfaces of two opposed, cooled moving endless flexible casting belts and laterally defined by first and second travelling side dams, the method comprising:

inserting a metal-feeding nosepiece into the entrance to said moving mold and clamping said nosepiece in position with rigid clamp structures above and below said nosepiece for holding said nosepiece sandwiched between said clamp structures with clearance gaps of less than 0.050 of an inch (1.27 mm) and more than 0.010 of an inch (0.25 mm) between said nosepiece and said moving belt surfaces, providing at least one metal-feeding passage extending downstream through said nosepiece and feeding the molten metal through said metal-feeding passage into the entrance to said moving mold, providing at least one gas-feeding passage extending downstream in at least one of said clamp structures exiting near one of said clearance gaps, and gently feeding an inert gas through said gas-feeding passage at a pressure minutely exceeding atmospheric pressure for avoiding air entrainment directed near the nearby moving belt surface for causing the respective moving belt surface to carry the inert gas through the respective clearance gap into the entrance to said moving mold, said inert gas being inert and essentially non-reactive in relation to the metal being cast.

5. The method as claimed in claim 4, including the steps of:

providing gas-feeding passages extending downstream in each of said clamp structures and exiting near the respective clearance gaps for gently directing the inert gas toward the respective clearance gap and toward the respective moving mold surface travelling toward the entrance to the moving belt for causing each of the moving belt surfaces to carry inert gas through the respective clearance gap into the entrance to the moving mold.

6. The method as claimed in claim 4, wherein the level of the molten metal in the entrance to the moving mold is maintained downstream from any metal-feeding passage in the nosepiece thereby creating a cavity in the entrance to the moving mold, said method including the step of:

causing at least one moving belt surface to carry the inert gas into said cavity for shrouding said cavity with the inert gas for excluding atmospheric gases from said cavity and for controlling the gas content of said cavity.

7. The method as claimed in claim 4, including the further step of:

channeling some of the inert gas to flow upstream in close proximity to at least one of the moving belt surfaces as it is approaching the entrance to the moving mold for causing said channeled gas to cleanse and displace atmospheric gases off from the respective moving belt surface before it enters the moving mold.

8. The method as claimed in claim 4, in which:

the said inert gas is heavier than air and is applied to the area above the said nosepiece through said gas-feeding passage in an upper clamp structure, and in addition, an inert gas that is lighter than air is similarly applied to the area below the said nosepiece through at least one additional gas-feeding passage in a lower clamp stucture.

9. The method as claimed in claim 4, in which:

the said inert gas is purified argon and is applied to the area above the said nosepiece through said gas-feeding passage in an upper clamp structure, and in addition, purified nitrogen is similarly applied to the area below the said nosepiece through at least one additional gas-feeding passage in a lower clamp structure.

10. The method for continuously casting metal product directly from molten metal, wherein the molten metal is introduced into a moving mold whose downstream direction is approximately horizontal or downwardly inclined, said moving mold being defined between opposed moving mold surfaces, said method comprising:

inserting a metal-feeding nosepiece into the entrance to said moving mold and clamping said nosepiece in position with rigid clamp structures above and below said nosepiece for holding said nosepiece sandwiched between said clamp structures with upper and lower clearance gaps of more than 0.010 of an inch (0.25 mm) and less than 0.050 of an inch (1.27 mm) respectively above and below the nosepiece between said nosepiece and said moving mold surfaces, providing at least one metal-feeding passage extending downstream through said nosepiece and feeding the molten metal through said metal-feeding passage into the entrance to said moving mold, providing at least one gas-feeding passage extending downstream in at least one of said clamp structures exiting near one of said clearance gaps near the respective moving mold surface, and gently feeding an inert gas through said gas-feeding passage at a pressure minutely exceeding atmospheric pressure directed toward the clearance gap between the nosepiece and the respective near moving mold surface for causing the moving mold surface to entrain some of said inert gas thereby displacing adsorbed and entrained contaminant gases, and to carry the inert gas into the entrance to said moving mold, said inert gas being inert and essentially non-reactive in relation to the metal being cast.

11. The method as claimed in claim 10, including the steps of:

providing gas-feeding passages extending downstream in each of said clamp structures and exiting near the respective clearance gaps for gently directing the inert gas toward the respective clearance gap and toward the respective moving mold surface travelling toward the entrance to the moving mold for causing both of the moving mold surfaces to carry inert gas through the respective clearance gap into the entrance to the moving mold.

12. The method as claimed in claim 10, wherein the level of the molten metal in the entrance to the moving mold is maintained downstream from any metal-feeding passage in the nosepiece thereby creating a cavity in the entrance to the moving mold, said method including the step of:

causing at least one moving mold surface to carry the inert gas into said cavity for shrouding said cavity with the inert gas for excluding atmospheric gases from said cavity and for controlling the gas content of said cavity.

13. The method as claimed in claim 10, including the step of:

gently feeding a heavier-than-air inert gas above said metal-feeding nosepiece for causing the inert gas to tend to lie down upon the nosepiece near the upper clearance gap.

14. The method as claimed in claim 10, including the step of:

gently feeding a lighter-than-air inert gas below said metal-feeding nosepiece for causing the inert gas to tend lie up against the nosepiece near the upper clearance gap.

15. The method as claimed in claim 10, including the further step of:

channeling some of the inert gas to flow upstream in close proximity to at least one of the moving mold surfaces as it is approaching the entrance to the moving mold for causing said chanelled gas to cleanse atmospheric gases off from the respective moving mold surface before it enters the moving mold.

16. The method as claimed in claim 10, including the steps of:

gently feeding a heavier-than-air inert gas above said metal-feeding nosepiece for causing the inert gas to tend to lie down upon the nosepiece near the clearance gap, and simultaneously gently feeding a lighter-than-air inert gas below said metal-feeding nosepiece for causing the inert gas to tend to lie up against the nosepiece near the clearance gap.

17. The method for continuously casting metal product directly from molten metal, wherein the molten metal is introduced into a moving mold whose downstream direction is approximately horizontal or downwardly inclined, said moving mold being defined between opposed moving mold surfaces each travelling cylindrically curved when converging toward the entrance to the moving mold, said method comprising the steps of:

introducing molten metal into the entrance to the moving mold, introducing inert gas into the entrance to the moving mold, positioning cylindrically curved shield members in close proximity with the respective cylindrically curved moving mold surface approaching the entrance for defining a curved gas flow channel adjacent to the respective curved moving mold surface extending from said entrance in the direction counter to the direction of movement of the respective adjacent curved moving mold surface, and flowing inert gas upstream through each of said curved channels in a direction counter to the moving mold surfaces for displacing atmospheric gases from said moving mold surfaces as they approach the entrance to the moving mold.

18. The method for continuously casting metal product directly from molten metal, wherein the molten metal is introduced into a moving mold whose downstream direction is approximately horizontal or downwardly inclined, said moving mold being defined between opposed moving mold surfaces, said method comprising:

inserting a metal-feeding nosepiece into the entrance to said moving mold and clamping said nosepiece in position with rigid clamp structures above and below said nosepiece for holding said nosepiece sandwiched between said clamp structures with clearance gaps of less than 0.050 of an inch (1.27 mm) between said nosepiece and said moving mold surfaces, providing at least one metal-feeding passage extending downstream through said nosepiece and feeding the molten metal through said metal-feeding passage into the entrance to said moving mold, providing at least one gas-feeding passage extending downstream in at least one of said clamp structures exiting near one of said clearance gaps, gently feeding an inert gas through said gas-feeding passage at a pressure minutely exceeding atmospheric pressure directed toward the clearance gap between the nosepiece and the nearby moving mold surface for causing the moving mold surface to carry the inert gas into the entrance to said moving mold, said inert gas being inert and essentially non-reactive in relation to the metal being cast, providing at least one gas-feeding passage extending downstream in said nosepiece, and feeding inert gas through said latter gas-feeding passage directly into the entrance to the moving mold while simultaneously gently feeding inert gas through said gas-feeding passage in said clamp structure.

19. The method as claimed in claim 18, including the steps of:

providing a gas-feeding passage extending downstream in each of said clamp structures and exiting near the respective adjacent clearance gap for gently directing the inert gas toward the respective clearance gap and toward the respective moving mold surface travelling toward the entrance to the moving mold for causing at least one of the moving mold surfaces to carry inert gas through the respective clearance gap into the entrance to the moving mold.

20. The method as claimed in claim 18, wherein the level of the molten metal in the entrance to the moving mold is maintained downstream from any metal-feeding passage in the nosepiece thereby creating a cavity in the entrance to the moving mold, said method including the step of:

causing at least one moving mold surface to carry the inert gas into said cavity for shrouding said cavity with the inert gas for excluding atmospheric gases from said cavity and for controlling the gas content of said cavity.

21. The method as claimed in claim 19, wherein the level of the molten metal in the entrance to the moving mold is maintained downstream from any metal-feeding passage in the nosepiece thereby creating a cavity in the entrance to the moving mold, said method including the step of:

causing at least one moving mold surface to carry the inert gas into said cavity for shrouding said cavity with the inert gas for excluding atmospheric gases from said cavity and for controlling the gas content of said cavity.

22. The method as claimed in claim 18, including the further step of:

channeling some of the inert gas to flow upstream in close proximity to at least one of the moving mold surfaces as it is approaching the entrance to the moving mold for causing said channeled gas to cleanse atmospheric gases off from the respective moving mold surface before it enters the moving mold.

23. The method as claimed in claim 19, including the further step of:

channeling some of the inert gas to flow upstream in close proximity to at least one of the moving mold surfaces as it is approaching the entrance to the moving mold for causing said channeled gas to cleanse atmospheric gases off from the respective moving mold surface before it enters the moving mold.

24. The method as claimed in claim 20, including the further step of:

channeling some of the inert gas to flow upstream in close proximity to at least one of the moving mold surfaces as it is approaching the entrance to the moving mold for causing said channeled gas to cleanse atmospheric gases off from the respective moving mold surface before it enters the moving mold.

* * * * *